United States Patent [19]

Guthrie

[11] Patent Number: 4,535,396

[45] Date of Patent: Aug. 13, 1985

[54] SUNLIGHT READABLE ILLUMINATED INDICIA DISPLAY DEVICES

[75] Inventor: Don W. Guthrie, Bedford, Tex.

[73] Assignee: Aerospace Optics, Inc., Fort Worth, Tex.

[21] Appl. No.: 642,152

[22] Filed: Aug. 20, 1984

Related U.S. Application Data

[63] Continuation of Ser. No. 384,033, Jun. 1, 1982, abandoned.

[51] Int. Cl.[3] ..... F21V 9/00

[52] U.S. Cl. ..... 362/293; 40/541; 40/547; 362/27; 362/29; 362/268; 362/311

[58] Field of Search ..... 362/293, 27, 29, 268, 362/311; 40/541, 547

[56] References Cited

U.S. PATENT DOCUMENTS

| | | | |
|---|---|---|---|
| 2,168,221 | 8/1939 | Land . | |
| 2,420,270 | 5/1947 | Thomas | 350/311 |
| 2,904,662 | 9/1959 | Spring | 200/314 |
| 3,107,350 | 10/1963 | Arrasmith | 340/382 X |
| 3,188,437 | 6/1965 | Lauren | 200/311 |
| 3,226,864 | 1/1966 | Renler . | |
| 3,511,560 | 5/1970 | Hamilton | 350/276 |
| 3,682,531 | 8/1972 | Jeffers | 350/156 |
| 3,805,004 | 4/1974 | Kondo | 200/311 |
| 3,957,351 | 5/1976 | Stockwell | 350/276 R |

FOREIGN PATENT DOCUMENTS

| | | | |
|---|---|---|---|
| 1142394 | 2/1969 | United Kingdom | 200/310 |

OTHER PUBLICATIONS

Goldsmith, T. T., "Filters Aid Television", Radio--Craft, Jan. 1948, pp. 28-29.

"Micromesh Filter", Kaiser Aerospace & Electronics Publication.

Mancini, R. H., "High Contrast Filter System", IBM Tech. Disc. Bull., vol. 13, No. 5, Oct. 1970, pp. 1391-1392.

Yeukin, A. Ye., "Method of Reducing . . . Elements"; Soviet J. of Opt. Tech., Feb. 1972, p. 115.

*Primary Examiner*—Donald P. Walsh

*Attorney, Agent, or Firm*—Wm. T. Wofford; James C. Fails; Arthur F. Zobal

[57] ABSTRACT

Disclosed are indicia display devices that are sunlight readable and which comprise a lens system having one or more body portions each of which provides a transparent internal light reflecting medium interposed between a light receiving surface and a light transmitting surface; a legend plate disposed to receive light from the light transmitting surface, with the legend plate being a laminate made up of mutually bonded elements including one or more filters; and a light source disposed to supply light to the light receiving surface. Various specific configurations of the legend plate are disclosed.

40 Claims, 12 Drawing Figures

SUNLIGHT READABLE ILLUMINATED INDICIA DISPLAY DEVICES

This application is a continuation, of application Ser. No. 06/384,033, filed May 1, 1982 now abandoned.

FIELD OF THE INVENTION

The invention relates to devices for presenting indicia displays which are sunlight readable. These devices present illuminated displays using incandescent lamps or light emitting diodes as their source of illumination. The indicia is invisible in a light ambient of 10,000 foot-candles (direct sunlight) unless specifically illuminated by its light source. When illuminated the indicia is readable in light ambients from 0 to 10,000 foot-candles (direct sunlight).

Such indicia display devices are characterized by their miniature size, low operating power and low heat output. The miniature size is typically from 0.5 inches to 2.5 inches in depth with a front viewing surface of 0.1 to 4.5 square inches. The power requirements may be typically from 0.3 to 1.4 watts per legend position according to the light source configuration. The low heat output makes possible surface touch temperatures within a comfortable range for pushbutton switch applications.

Such indicia display devices may be typically used in illuminated pushbutton switches, indicators and annunciators. Some preferred applications of these indicia display devices are in aircraft instrumentation, avionics packages and in aircraft cockpits. In addition, these devices can be advantageously used in computer applications, on board ships, in space craft, in control towers and on portable outdoor ground support systems exposed to high ambient light level conditions.

BACKGROUND OF THE INVENTION

There have been numerous attempts in the prior art of which I am aware to provide devices of the above mentioned type for presenting displays which when illuminated are sunlight readable and when not illuminated are not visible, but to my knowledge, none of these devices have proved to be entirely satisfactory.

An indicia display is herein defined to be sunlight readable if in a light ambient of 10,000 foot-candles (direct sunlight):

1. The contrast ratio of the lighted indicia to the background is 0.6 minimum,
2. the contrast ratio of the lighted indicia to unlighted indicia is 0.6 minimum, and
3. the contrast ratio of unlighted indicia to background is 0.05 (absolute value) maximum.

The contrast ratio is determined as defined in MIL-L-27160 as follows:

$$C=(C_1-C_2)/C_2$$

where C is the contrast ratio, and, for requirement (1) above $C_1$ is the legend intensity of the lighted indicia and $C_2$ is the background intensity; for requirement (2) above $C_1$ is the legend intensity of the lighted indicia and $C_2$ is the legend intensity of the unlighted indicia; for requirement (3) above $C_1$ is the legend intensity of the unlighted indicia and $C_2$ is the background intensity.

An indicia display device which is sunlight readable as that term is defined above will meet or exceed the requirements set forth by MIL-STD-411D, paragraph 5.1.

It is to be understood that the term "indicia display devices" when used herein, refers only to indicia display devices having the characteristics hereinabove discussed, and that the term "indicia display" when used herein refers only to an indicia display that is presented by an "indicia display device". It is also to be understood that an indicia display may be sunlight readable as defined above but not completely invisible (in direct sunlight) when not illuminated.

In an application where indicia display devices are in a high ambient light environment such as direct sunlight, the above defined sunlight readable capability, together with the capability of being invisible when not illuminated, is highly desirable. A high ambient light environment may be generally defined as one where the ambient light levels are within the range of 8,000 to 13,000 foot-candles. In some applications, as for example, aircraft cockpit instrumentation display and particularly in some military aircraft, such sunlight readable capability together with the capability of being invisible when not illuminated, can be critical.

Accordingly, it is the general object of the invention to provide improved indicia display devices which have a sunlight readable capability together with the capability of being invisible when not illuminated.

Another object of the invention is to provide indicia display devices which are sunlight readable.

Another object of the invention is to provide indicia display devices which are invisible in a 10,000 foot-candle light ambient (in direct sunlight) when not illuminated.

Another object of the invention is to provide indicia display devices that are sunlight readable and are invisible when not illuminated, and are incorporated in a pushbutton switch.

For a further understanding of the invention and further objects, features, and advantages thereof reference may now be had to the following description, taken in conjunction with the accompanying drawings.

SUMMARY OF THE INVENTION

Figure 1:
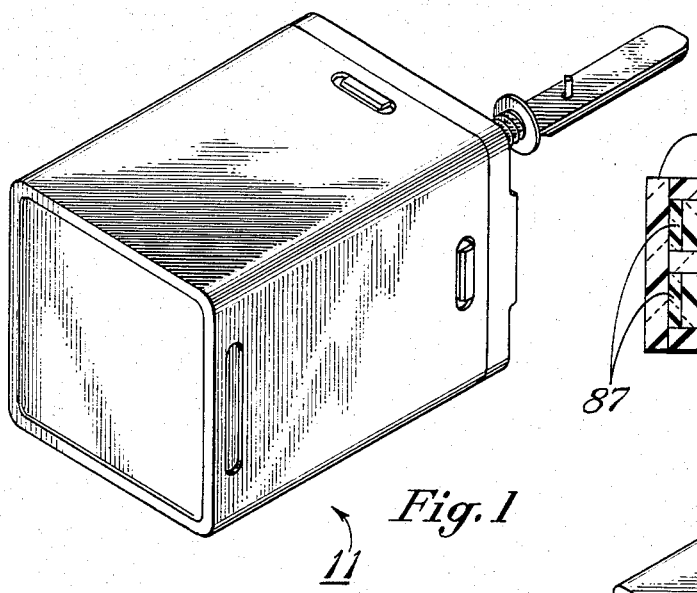
FIG. 1 is a schematic perspective view showing an indicia display device in accordance with a preferred embodiment of the invention.

In accordance with the invention, there are provided indicia display devices in which a lens system has one or more body portions each of which provides a transparent internal light reflecting medium interposed between a light receiving surface and a light transmitting surface; a legend plate is disposed to receive light from said light transmitting surface, said legend plate being a laminate made up of mutually bonded elements including one or more filters; and a light source is disposed to supply light to said light receiving surface.

In a preferred embodiment of the invention, each said lens system body portion has the form of a bar having end faces, with one end face being said light receiving surface and the opposite end face being said light transmitting surface, with the lens system being contained within a housing having an opening extending longitudinally therethrough for each said bar and sized to conformingly receive a respective said bar, with the legend plate being bonded to said light transmitting surface and also to the front face of said housing.

The legend plate may have various specific configurations, as for example, the mutually bonded elements in order from front to rear may be a first absorption filter having a diffuse front surface, a black legend carrying element, and a second filter; or they may be a first absorption filter having a diffuse front surface, a black legend carrying element, a second absorption filter, and a diffuser element; or they may be a first gray absorption filter having a diffuse front surface, a black legend carrying element, and a second gray absorption filter; or they may be a first gray absorption filter having a diffuse front surface, a black legend carrying element, a second absorption filter, and a colored filter; or they may be a first gray absorption filter having a diffuse front surface and a black back surface having legends thereon, a colored filter, and a white diffuser.

In accordance with one embodiment of the invention, the legend plate may be bonded to the lens system housing front face and to a respective colored filter element which is contained within a said opening adjacent the front face, with the respective colored filter element being in turn bonded to a respective white diffuser element which in turn is bonded to said light transmitting surface and with the legend plate being made up of mutually bonded elements including in order from front to rear a gray absorption filter having a diffuse front surface and a black back surface having legends thereon and a clear plastic backing for protection of the black back surface and legends.

In accordance with another embodiment of the invention, the legend plate is made up of mutually bonded elements including in order from front to rear a first gray absorption filter having a diffuse front surface and a black back surface having legends thereon with a clear plastic backing for protection of the black back surfaces and legends, a second absorption filter, and a diffuser, with a colored filter being disposed adjacent a respective lens system light receiving surface.

DESCRIPTION OF PREFERRED EMBODIMENTS

Figure 2:
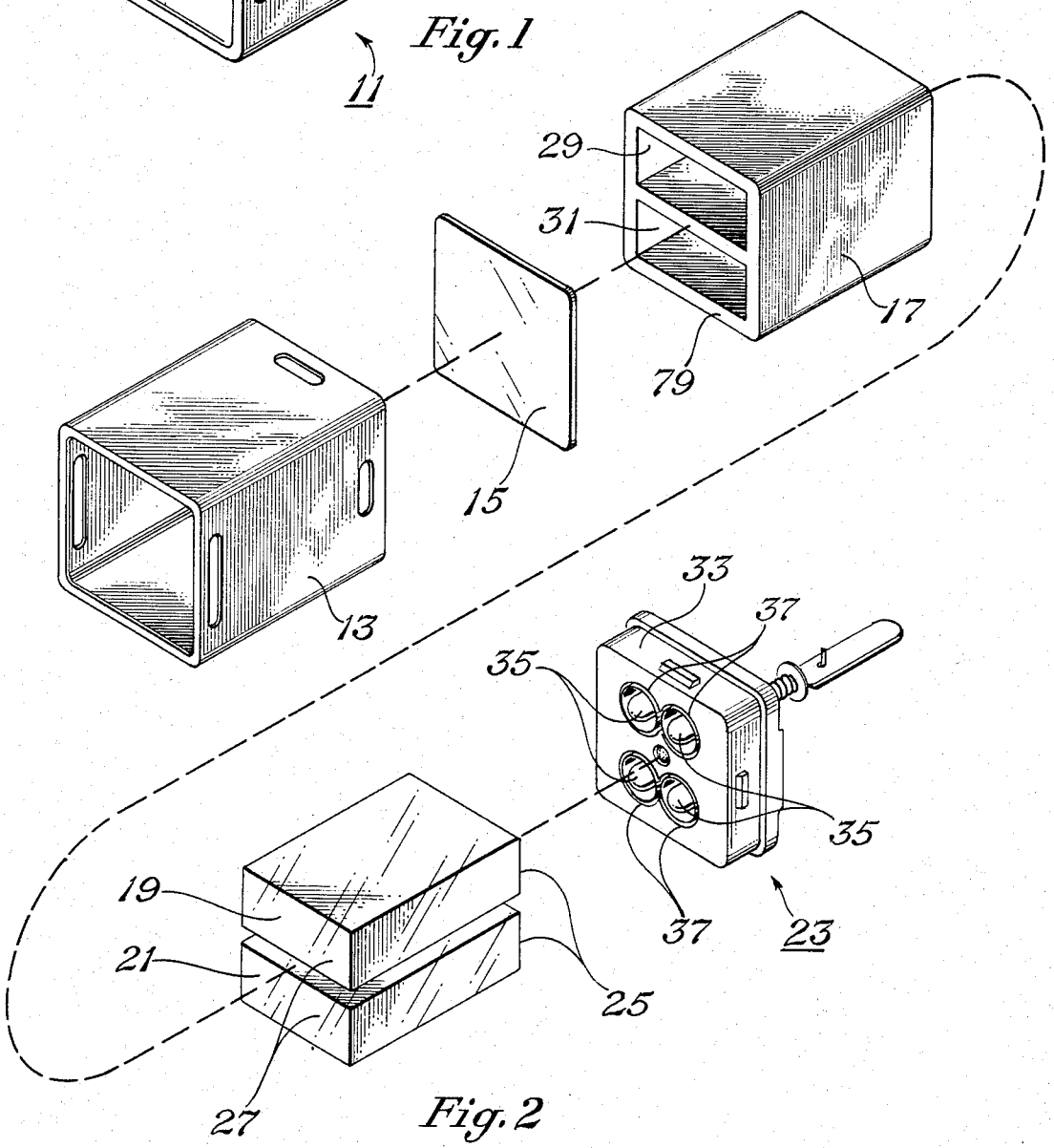
FIG. 2 is an exploded view showing the parts of the indicia display device of FIG. 1.

For a description of preferred embodiments of the invention, reference is made to the drawings in which FIG. 1 is a schematic perspective showing of a typical indicia display device assembly 11, the parts of which are shown in the exploded view of FIG. 2 and include an outer case 13, legend plate 15, lens housing 17, lenses 19, 21 and light source 23.

The lenses 19, 21 are in the form of rectangular bars of transparent material, preferably plastic, and having smooth or polished exterior surfaces, so that the lenses each provide a transparent internal light reflecting medium interposed between a respective light receiving surface 25 and light transmitting surface 27. The lenses 19, 21 are contained within the lens housing 17 which has a rectangular opening 29, 31 extending therethrough for each lens or bar 19, 21 and sized to conformingly receive the respective bar.

The legend plate 15 is a laminate made up of mutually bonded elements including one or more filters and may have various specific configurations, as will be presently discussed with reference to FIGS. 7–11. Also, the legend plate-lens system assembly may have various specific configurations, as will be presently discussed with reference to FIGS. 4–6 and 12.

The light source 23, in the embodiment shown, includes a housing 33 of molded thermoplastic material carrying four miniature incandescent lamps 35, with a respective reflector 37 for each lamp. The lamp voltage and current will depend on the type of lamps used, but may typically range from 5 volts and 0.06 amperes to 28 volts and 0.024 amperes.

Figure 3:
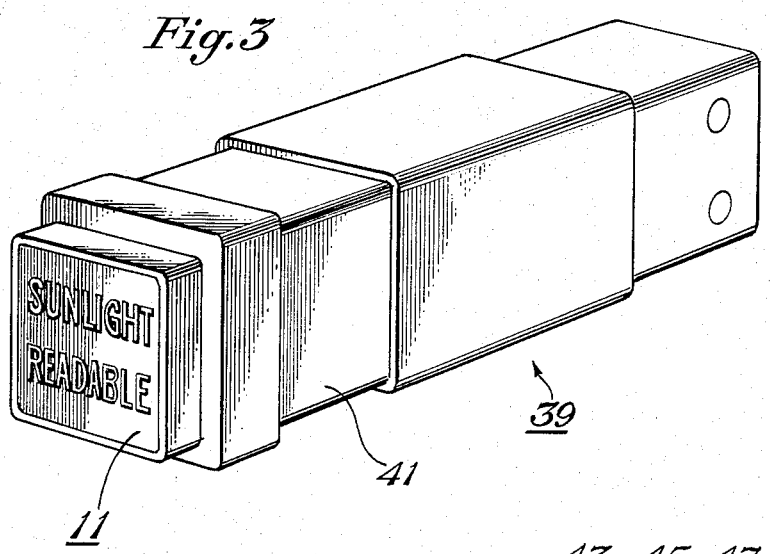
FIG. 3 is a schematic perspective view showing the indicia display device of FIG. 1 incorporated in a pushbutton switch.
Figure 9:
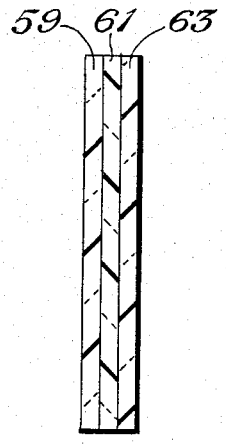
FIGS. 7–11 are schematic section views showing various legend plate arrangements.

FIG. 3 shows the indicia display device 11 of FIG. 1 incorporated in a typical push button switch 39. The indicia display device 11 is movable within the housing 41 of the push button switch 39 to actuate switch devices (not shown) which are contained within the housing of the push button switch. Power is supplied to the lamps of the indicia display device 11 and connections are made to the above mentioned switch devices in a conventional manner (not shown).

As previously mentioned herein, the legend plate 15 of the indicia display device 11 may have various specific configurations, as illustrated by FIGS. 7–11. In FIGS. 7–11, the mutually bonded elements of the legend plate 15, taken in order from front to rear (left to right in the drawings) are: in FIG. 7, a first absorption filter having a diffuse front surface 43, a black legend carrying element 45, and a second filter 47; in FIG. 8, a first absorption filter having a diffuse front surface 49, a black legend carrying element 51, a second absorption filter 53, and a diffuser element 57; in FIG. 9, a first gray absorption filter having a diffuse front surface 59, a black legend carrying element 61, and a second gray absorption filter 63; in FIG. 10, a first gray absorption filter having a diffuse front surface 65, a black legend carrying element 67, a second absorption filter 69, and a colored filter 71; in FIG. 11, a first gray absorption filter having a diffuse front surface and a black back surface having legends thereon 73, a colored filter 75, and a white diffuser 77.

Figure 4:
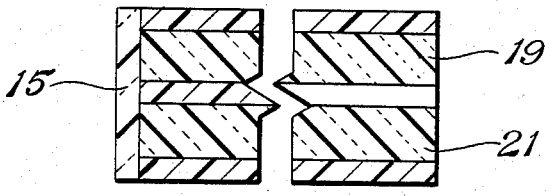
Figure 7:
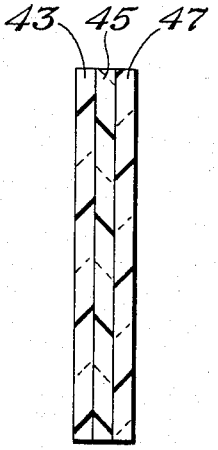
Figure 10:
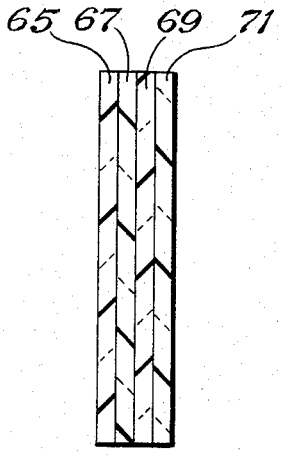

In the embodiment shown in FIG. 4, the legend plate 15 is bonded to the light transmitting surface 27 of each lens 19, 21 and to the front face 79 of the lens housing 17.

Figure 5:
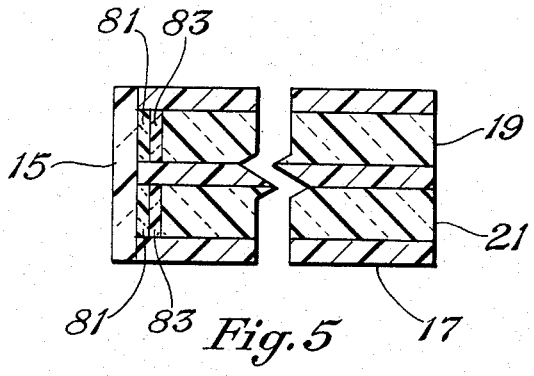
Figure 8:
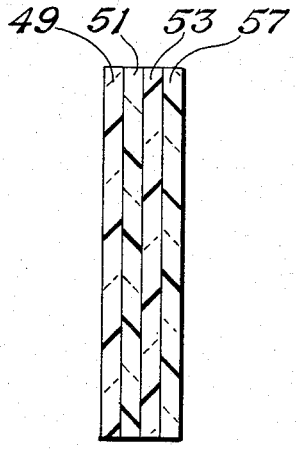
Figure 11:
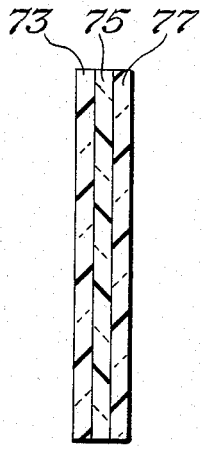

In the embodiment shown in FIG. 5, the legend plate 15 is made up of mutually bonded elements including in order from front to rear a gray absorption filter having a diffuse front surface and a black back surface having legends thereon with a clear plastic backing for protection of the black back surface and legends. The legend plate 15 is bonded to the lens system housing front face 79 and also to a respective colored filter element 81 which is contained within the lens system housing adjacent the front face thereof, with the respective colored filter element 81 being in turn bonded to a respective white diffuser element 83 which in turn is bonded to the respective light transmitting surface 27 of a lens 19, 21.

Figure 6:
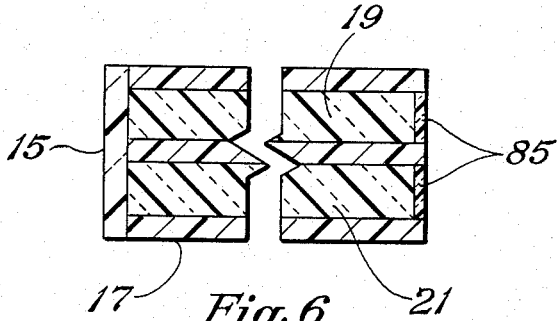

In the embodiment shown in FIG. 6, the legend plate 15 is made up of mutually bonded elements including in order from front to rear a first gray absorption filter having a diffuse front surface and a black back surface having legends thereon with a clear plastic backing for protection of the black back surface and legends, and a diffuser. The legend plate 15 is bonded to the light transmitting surface 27 of each lens 19, 21 and also to the front face 79 of the lens housing 17. In addition, a respective colored filter element 85 is bonded to the light receiving surface 25 of a respective lens 19, 21.

Figure 12:
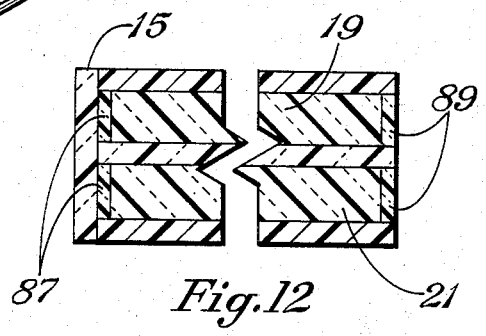
FIGS. 4–6 and 12 are schematic section views showing various legend plate and lens system arrangements.

In the embodiment shown in FIG. 12, the legend plate 15 is made up of mutually bonded elements including in order from front to rear a gray absorption filter having a diffuse front surface and a black back surface having legends thereon with a clear plastic backing for protection of the black back surface and legends. The legend plate 15 is bonded to the lens system housing front face 79 and also to a filter 87 which is contained within the lens system having adjacent the front face thereof, with the filter 87 being in turn bonded to the respective light transmitting surface 27 of a lens 19, 21. The filter 87 may be a laminate made up of a plurality of mutually bonded filter elements. In addition, a filter 89 is bonded to the light receiving surface 25 of a respective lens 19, 21. The filter 89 may be a laminate made up of a plurality of mutually bonded filter elements.

The mutually bonded elements of the legend plate 15, as well as the lenses 19, 21 are preferably made of acrylic plastic material.

When bonding elements of the legend plate, with the exception of the case where a clear plastic backing is bonded to a black back surface, the bonding is preferably accomplished by use of an acrylic adhesive material designated PS-30, known as "CADCO", manufactured by Cadillac Plastics, of Detroit, Mich. The bonding of the clear plastic backing to the black back surface is preferably accomplished by use of an epoxy material known as Scotch Weld Structural Adhesive No. 3520, manufactured by the 3M Company. When bonding the legend plate 15 to the lens system housing front face 79 and to the lens light transmitting surface 27 or a colored filter element 81 that is disposed within the lens housing 17, the bonding is preferably accomplished by use of a polyester resin material known as "CLEAR CAST", a liquid casting plastic distributed by American Handicrafts Co., of Fort Worth, Tex. Such polyester resin material is also preferably used to bond a filter element 85 to the lens light receiving surface 25. If the legend plate elements or lenses were made of glass, then epoxy material (such as Scotch Weld Structural Adhesive No. 3520) would preferably be used to accomplish the requisite bonding.

Although the rectangular lens from 19, 21 is the preferred embodiment, other forms could be used, as for example, the transverse section of the lens or bar could be circular, oval, or polygonal. Also, the lens or bar longitudinal section in some embodiments may be wedge-shaped. The number of lenses used for a single indicia display device will vary depending upon the type of legend display desired. Typically, there may be a single lens having a rectangular transverse section; or two lenses having rectangular transverse section, as shown in FIG. 2 hereof: or four lens having rectangular transverse section; or three lenses, one of which has a larger rectangular transverse section and the other two having smaller rectangular transverse section. Whatever the particular configuration, the lenses are basically light pipes or conduits.

The light source can be made up of one or more miniature incandescent lamps, typically four for a push button switch application, as shown by FIG. 2 hereof. If desired, light emitting diodes may be used instead of incandescent lamps. Also, the use of reflectors for the lamps or diodes is preferable, but may not in every case be essential.

The foregoing disclosure and the showings made in the drawings are merely illustrative of the principles of this invention and are not to be interpreted in a limiting sense.

What is claimed is:

1. An indicia display device for presenting an indicia display that is sunlight readable, comprising:

a. a lens system having one or more body portions each of which provides a transparent internal light reflecting medium interposed between a light receiving surface and a light transmitting surface;

b. a legend plate disposed to receive light from said light transmitting surface, said legend plate being a laminate made up of mutually bonded elements including one or more filters and wherein the front bonded element is an absorption filter having a diffuse front surface; and c. a light source disposed to supply light to said light receiving surface;

d. said lens system, legend plate and light resulting in an indicia display device wherein the contrast ratio of the lighted indicia to background is 0.6 minimum, the contrast ratio of the lighted indicia to unlighted indicia is 0.6 minimum, and the contrast ratio of unlighted indicia to background is 0.05 (absolute value) maximum, with said contrast ratios being measured in an ambient light level of not less than 10,000 foot candles including light resulting from direct sunlight impinging on said indicia display device at a glare producing angle.

2. The device of claim 1 wherein said legend plate is disposed in abutting relation to said light transmitting surface.

3. The device of claim 1 wherein said legend plate is bonded to said light transmitting surface.

4. The device of claim 1 wherein said mutually bonded elements include in order from front to rear a first absorption filter having a diffuse front surface, a black legend carrying element, and a second absorption filter.

5. The device of claim 1 wherein said mutually bonded elements include in order from front to rear a first absorption filter having a diffuse front surface, a black legend carrying element, a second absorption filter, and a diffuser element.

6. The device of claim 1 wherein said mutually bonded elements include in order from front to rear a first gray absorption filter having a diffuse front surface, a black legend carrying element, and a second gray absorption filter.

7. The device of claim 1 wherein said mutually bonded elements include in order from front to rear a first gray absorption filter having a diffuse front surface, a black legend carrying element, a second absorption filter, and a colored filter.

8. The device of claim 1 wherein said mutually bonded elements include in order from front to rear a first gray absorption filter having a diffuse front surface, and a black back surface having legends thereon, a colored filter, and a white diffuser.

9. The device of claim 1 wherein said mutually bonded elements include in order from front to rear a first gray absorption filter having a diffuse front surface, and a black back surface having legends thereon with a clear plastic backing for protection of the black back surfaces and legends; a colored filter, and a white diffuser.

10. The device of claim 1 wherein said mutually bonded elements include in order from front to rear a first gray absorption filter having a diffuse front surface and a black back surface having legends thereon, a second absorption filter, and a diffuser, with a colored filter being disposed adjacent said light receiving surface.

11. The device of claim 10 wherein said colored filter is a laminate made up of an absorption filter and a colored filter.

12. An indicia display device for presenting an indicia display that is sunlight readable, comprising:

a. a lens system having one or more body portions each of which provides a transparent internal light reflecting medium interposed between a light receiving surface and a light transmitting surface, each said body portion having the form of a bar having end faces, with one end face being said light receiving surface and the opposite end face being said light transmitting surface;

b. a legend plate disposed to receive light from said light transmitting surface, said legend plate being a laminate made up of mutually bonded elements including a plurality of filters and wherein the front bonded element is an absorption filter having a diffuse front surface; and c. a light source disposed to supply light to said light receiving surface;

d. said lens system, legend plate and light resulting in an indicia display device wherein the contrast ratio of the lighted indicia to background is 0.6 minimum, the contrast ratio of the lighted indicia to unlighted indicia is 0.6 minimum, and the contrast ratio of unlighted indicia to background is 0.05 (absolute value) maximum, with said contrast ratios being measured in an ambient light level of not less than 10,000 foot candles including light resulting from direct sunlight impinging on said indicia display device at a glare producing angle.

13. The device of claim 12 wherein said legend plate is disposed in abutting relation to said light transmitting surface.

14. The device of claim 12 wherein said legend plate is bonded to said light transmitting surface.

15. The device of claim 12 wherein said mutually bonded elements include in order from front to rear a first absorption filter having a diffuse front surface, a black legend carrying element, and a second absorption filter.

16. The device of claim 12 wherein said mutually bonded elements include in order from front to rear a first absorption filter having a diffuse front surface, a black legend carrying element, a second absorption filter, and a diffuser element.

17. The device of claim 12 wherein said mutually bonded elements include in order from front to rear a first gray absorption filter having a diffuse front surface, a black legend carrying element, and a second gray absorption filter.

18. The device of claim 12 wherein said mutually bonded elements include in order from front to rear a first gray absorption filter having a diffuse front surface, a black legend carrying element, a second absorption filter, and a colored filter.

19. The device of claim 12 wherein said mutually bonded elements include in order from front to rear a first gray absorption filter having a diffuse front surface, and a black back surface having legends thereon, a colored filter, and a white diffuser.

20. The device of claim 12 wherein said mutually bonded elements include in order from front to rear a first gray absorption filter having a diffuse front surface, and a black back surface having legends thereon with a clear plastic backing for protection of the black back surfaces and legends, a colored filter, and a white diffuser.

21. The device of claim 12 wherein said mutually bonded elements include in order from front to rear a first gray absorption filter having a diffuse front surface and a black back surface having legends thereon, a second absorption filter, and a diffuser with a colored filter being disposed adjacent said light receiving surface.

22. The device of claim 21 wherein said colored filter is a laminate made up of an absorption filter and a colored filter.

23. An indicia display device for presenting an indicia display that is sunlight readable, comprising:

a. a lens system having one or more body portions each of which provides a transparent internal light reflecting medium interposed between a light receiving surface and a light transmitting surface, each said body portion having the form of a bar having end faces, with one end face being said light receiving surface and the opposite end face being said light transmitting surface, said lens system being contained within a housing having an opening extending longitudinally therethrough for each said bar and sized to conformingly receive a respective said bar, with said housing having a front face;

b. a legend plate disposed to receive light from said light transmitting surface, said legend plate being a laminate made up of mutually bonded elements including a plurality of filters and wherein the front bonded element is an absorption filter having a diffuse front surface; and c. a light source disposed to supply light to aid light receiving surface;

d. said lens system, legend plate and light resulting in an indicia display device wherein the contrast ratio of the lighted indicia to background is 0.6 minimum, the contrast ratio of the lighted indicia to unlighted indicia is 0.6 minimum, and the contrast ratio of unlighted indicia to background is 0.05 (absolute value) maximum, with said contrast ratios being measured in an ambient light level of not less than 10,000 foot candles including light resulting from direct sunlight impinging on said indicia display device at a glare producing angle.

24. The device of claim 23 wherein said legend plate is disposed in abutting relation to said light transmitting surface.

25. The device of claim 23 wherein said legend plate is bonded to said light transmitting surface and to the front face of said housing.

26. The device of claim 23 wherein said mutually bonded elements include in order from front to rear a first absorption filter having a diffuse front surface, a black legend carrying element, and a second absorption filter.

27. The device of claim 23 wherein said mutually bonded elements include in order from front to rear a first absorption filter having a diffuse front surface, a black legend carrying element, a second absorption filter, and a diffuser element.

28. The device of claim 23 wherein said mutually bonded elements include in order from front to rear a first gray absorption filter having a diffuse front surface, a black legend carrying element, and a second gray absorption filter.

29. The device of claim 23 wherein said mutually bonded elements include in order from front to rear a first gray absorption filter having a diffuse front surface, a black legend carrying element, a second absorption filter, and a colored filter.

30. The device of claim 23 wherein said mutually bonded elements include in order from front to rear a first gray absorption filter having a diffuse front surface, and a black back surface having legends thereon, a colored filter, and a white diffuser.

31. The device of claim 23 wherein said mutually bonded elements include in order from front to rear a first gray absorption filter having a diffuse front surface, and a black back surface having legends thereon with a clear plastic backing for protection of the black back surfaces and legends, a colored filter, and a white diffuser.

32. The device of claim 23 wherein said mutually bonded elements include in order from front to rear a first gray absorption filter having a diffuse front surface and a black back surface having legends thereon, a second absorption filter, and a diffuser, with a colored filter being disposed adjacent said light receiving surface.

33. The device of claim 32 wherein said colored filter is a laminate made up of an absorption filter and a colored filter.

34. An indicia display device for an indicia display that is sunlight readable, comprising:

a. a lens system having one or more body portions each of which provides a transparent internal light reflecting medium interposed between a light receiving surface and a light transmitting surface, each said body portion having the form of a bar having end faces, with one end face being said light receiving surface and the opposite end face being said light transmitting surface, said lens system being contained within a housing having an opening extending longitudinally therethrough for each said bar and sized to conformingly receive a respective said bar, with said housing having a front face;

b. a legend plate bonded to said lens system housing front face and to a respective filter contained within a said opening adjacent the said front face, and with said filter being in turn bonded to said light transmitting surface, said legend plate being a laminate made up of mutually bonded elements including in order from front to rear a gray absorption filter having a diffuse front surface and a black back surface having legends thereon and a clear plastic backing for protection of said black back surface and legends; and c. a light surface disposed to supply light to said light receiving surface;

d. said lens system, legend plate and light resulting in an indicia display device wherein the contrast ratio of the lighted indicia to background is 0.6 minimum, the contrast ratio of the lighted indicia to unlighted indicia is 0.6 minimum and the contrast ratio of unlighted indicia to background is 0.05 (absolute value) maximum, with said contrast ratios being measured in an ambient light level of not less than 10,000 foot candles including light resulting from direct sunlight impinging on said indicia display device at a glare producing angle.

35. The device of claim 34 wherein said filter contained within said opening is a colored filter element and is in turn bonded to a white diffuser element which in turn is bonded to said light transmitting surface.

36. The device of claim 35 wherein a colored filter is disposed adjacent said light receiving surface.

37. The device of claim 35 wherein a colored filter is bonded to said light receiving surface.

38. The device of claim 34 wherein a filter is bonded to said light receiving surface.

39. The device of claim 38 wherein said filter contained within said opening is a laminate made up of a plurality of mutually bonded filter elements.

40. The device of claim 39 wherein said filter which is bonded to said light receiving surface is a laminate made up of a plurality of mutually bonded filter elements.

* * * * *